US007140833B2

(12) United States Patent
Bailey

(10) Patent No.: US 7,140,833 B2
(45) Date of Patent: Nov. 28, 2006

(54) INTEGRATED TURBO/DRAG/REGENERATIVE PUMP WITH COUNTER-ROTATING TURBO BLADES

(75) Inventor: Christopher M. Bailey, Horsham (GB)

(73) Assignee: The BOC Group, LLC, Murray Hill, NJ (US)

( * ) Notice: Subject to any disclaimer, the term of this patent is extended or adjusted under 35 U.S.C. 154(b) by 115 days.

(21) Appl. No.: 10/981,226

(22) Filed: Nov. 4, 2004

(65) Prior Publication Data

US 2006/0093473 A1 May 4, 2006

(51) Int. Cl.
*F01D 1/24* (2006.01)

(52) U.S. Cl. ..... 415/1; 415/61; 415/62; 415/64; 415/69; 415/143; 417/16; 417/202; 417/423.4

(58) Field of Classification Search ..... 415/1, 415/61, 62, 64, 65, 68, 69, 90, 143; 417/16, 417/201, 202, 203, 423.4, 423.5; 62/55.5
See application file for complete search history.

(56) References Cited

U.S. PATENT DOCUMENTS 4,717,315 A * 1/1988 Miki et al. ..... 417/365
4,878,813 A * 11/1989 Miki ..... 417/2
6,106,223 A 8/2000 Leyshon
6,116,032 A * 9/2000 Mori et al. ..... 62/55.5
6,135,709 A 10/2000 Stones
6,709,228 B1 3/2004 Stuart
6,752,588 B1 6/2004 Kawanishi et al.

FOREIGN PATENT DOCUMENTS

SU 688708 * 9/1979

* cited by examiner

*Primary Examiner*—Edward K. Look
*Assistant Examiner*—Nathan Wiehe
(74) *Attorney, Agent, or Firm*—Ira Lee Zebrak; Mary K. Nicholes

(57) ABSTRACT

The present invention relates to vacuum pumps and a method for creating and maintaining a high vacuum. A vacuum pump includes a regenerative section and a turbo-molecular section. A common first rotor carries forward-rotating elements of both the regenerative section and the turbo-molecular section. Additionally, a second rotor carries counter-rotating elements of the turbo-molecular section. A first drive rotates the first rotor in a forward rotational direction while a second drive rotates the second rotor in a counter-rotational direction. The drives may be controlled to drive the common first rotor on start-up, and to later drive the second rotor.

20 Claims, 4 Drawing Sheets

INTEGRATED TURBO/DRAG/REGENERATIVE PUMP WITH COUNTER-ROTATING TURBO BLADES

FIELD OF THE INVENTION

The present invention relates generally to the field of vacuum pumping, and more particularly, to a momentum transfer pump of the hybrid or compound type having two or more sections of different operational mode for improving the operating range or throughput of the pump.

BACKGROUND OF THE INVENTION

Certain research and manufacturing processes require the use of a process chamber with high vacuum. For example, in semiconductor wafer processing, vacuum is used during the thin-film deposition and etching operations, primarily to reduce contamination. In such processes, pumps capable of producing a "high vacuum" of $10^{-6}$ torr or lower are useful to assure adequate pumping speed at process pressure, and to allow for a low base pressure for cleanup between steps.

Several currently-available vacuum pump configurations are capable of maintaining a high vacuum. One design, the turbo-molecular vacuum pump, is frequently used in both manufacturing processes and in research instrumentation. A conventional stage arrangement of a turbo-molecular vacuum pump includes a stack of alternate rotors and stators. Each stage effectively comprises a solid disc with a plurality of blades depending (nominally) radially inwardly or outwardly therefrom. The blades are evenly spaced around the circumference of the disc and angled "about" radial lines out of the plane of the disc in the direction of rotation of the rotor stage.

The rotor and stator blades have positive and negative gradients respectively when viewed from the side in a radial line from the disc. That arrangement has the effect, in molecular flow conditions, of causing a movement of molecules through the pump.

The turbo-molecular vacuum pump is inefficient or inoperable outside the molecular flow realm. For that reason, a commercially available vacuum pump may contain, in addition to several turbo-molecular stages, one or more molecular drag stages and one or more regenerative stages placed between the turbo-molecular stages and the pump outlet.

Referring to FIG. 1, there is illustrated a known compound vacuum pump 100 comprising a turbo-molecular section 50, a regenerative section 1 and a molecular drag section 2. Attached to a rotor 9 is a cylindrical rotor body 52 of the turbo-molecular section 50, placed at an inlet 31 of the pump. Extending radially outwardly from the rotor body 52 are rotor vanes 54 which collectively define three spaced arrays of vanes, each array having approximately 20 vanes.

The turbo-molecular section 50 also includes a stator 56 which is formed integrally with a body 22. Extending radially inwardly from the stator 56 are stator vanes 58 defining three spaced arrays of vanes, each array including about 20 vanes. The vanes 54 of the rotor interleaf with the vanes 58 of the stator and are angled relative to each other as is known in the turbo-molecular vacuum pump art.

The rotor 9 also comprises the rotor portion of the regenerative section 1. That portion includes a series of concentric rows of airfoils such as airfoil 10 that induce motion to the gas contained in channels 11. The channels 11 are stationary and are attached to the body 22 and stator 56. The regenerative portion of the pump is arranged to exhaust through the pump outlet 32.

The molecular drag section of the exemplary prior art pump illustrated in FIG. 1 is a Holweck section that includes cylindrical rotor sections 26, 27 and cylindrical stator sections 23, 24. The rotor sections 26, 27 are attached to the pump rotor 9, while the stator sections 23, 24 are attached to the pump stator. Helical grooves in the rotors and stators interact at close running clearances, transferring air molecules from the turbo-molecular section to the regenerative section.

A high-speed drive (not shown) is connected to a shaft 60 to drive the rotating components of the pump. The shaft, rotors and drive are supported by high speed, low friction bearings (not shown) such as dry ceramic race ball bearings or magnetic levitation bearings.

Operation of the turbo-molecular section of the above-described system requires high relative velocity of the turbo-molecular stators and rotors. On the other hand, the angular velocity of the rotor is limited by stresses placed on the components by centripetal acceleration, and also by maximum operating speeds of the other pump sections. Special fasteners and larger component cross sections are sometimes used to reduce stress and to permit a higher rotational speed.

The pumping speed requirements of the turbo-molecular section are often met by increasing the overall diameter of the pump, imparting a greater tangential velocity to the outer portions of the rotor vanes for a given rotational speed. That solution, however, increases the overall package size.

To start the above-described pump, the enclosed volume of the turbo-molecular section must first be partially evacuated. That is done to permit rotation of the opposing vanes in that section at the required high speeds. An additional downstream "roughing" pump is sometimes used for that purpose. A valved bypass line may be provided to permit the system to be pumped down without the turbo offering a restriction.

There is therefore presently a need to provide an improved compound or hybrid vacuum pump including a turbo-molecular pump section. Particularly, the improved pump should provide a solution to the conflicting speed requirements, and should reduce the need to evacuate the pump at start-up using a roughing pump. To the inventor's knowledge, there is currently no such technique available.

SUMMARY OF THE INVENTION

The present invention addresses the needs described above by providing an improved vacuum exhaust pump and a method for controlling the pump. In one embodiment, a vacuum exhaust pump having a turbo-molecular pump section and a regenerative pump section is provided. The pump includes a regenerative rotating group mounted for rotation about a pump axis, a turbo rotating group connected to the regenerative rotating group for rotation therewith, and a first drive connected to the regenerative rotating group and the turbo rotating group for rotating those groups in a first rotational direction. The pump also includes a turbo counter-rotating group mounted for rotation about the pump axis, and a second drive connected to the turbo counter-rotating group for rotating the turbo counter-rotating group in at least a second rotational direction opposite the first rotational direction.

The turbo counter-rotating group may be an outer rotor of a turbo-molecular pump section, or may be an inner rotor. The turbo counter-rotating group may be mounted on magnetic levitation bearings.

The vacuum exhaust pump may also include a pump controller for controlling the first and second drives. That controller is configured to activate the first drive during start-up to rotate the regenerative rotating group and the turbo rotating group in the first direction without activating the second drive.

The second drive may be for rotating the turbo counter-rotating group in both the first rotational direction and the second rotational direction.

The vacuum exhaust pump may include a drive control configured to rotate the turbo counter-rotating group in the first rotational direction during start-up, and to rotate the turbo counter-rotating group in the second rotational direction after a sufficient vacuum is drawn. The controller may further be configured to progressively transition the turbo rotating group from rotation in the first rotational direction to rotation in the second rotational direction.

The pump may have a regenerative stator group having a close running clearance with the regenerative rotating group to form the regenerative pump section. A pump inlet may enter the turbo pump section, and a pump outlet may leave the regenerative pump section. The pump may also include a molecular drag rotating group connected to the regenerative rotating group for rotation therewith.

In another embodiment of the invention, a vacuum exhaust pump includes at least a regenerative section, a turbo-molecular section, a first rotor common to both sections, and a separately rotating second rotor of the turbo-molecular section.

The vacuum exhaust pump may also include a first drive to drive the first rotor in a first rotational direction, and a second drive to drive the second rotor in a direction opposite the first. The pump may further include a controller for activating the first drive during startup before activating the second drive.

In another embodiment, a method is provided for controlling a vacuum exhaust pump having a turbo-molecular pump section and a regenerative pump section. The method includes the steps of rotating in a first rotational direction a first rotor supporting elements of both pump sections, and, after sufficient vacuum has been drawn in the turbo-molecular pump section, rotating in a second rotational direction, opposite the first, a second rotor supporting additional elements of the turbo-molecular pump section.

The method may include the step of, before sufficient vacuum has been drawn in the turbo-molecular pump section, rotating the second rotor in the first rotational direction. The step of rotating the second rotor in the first rotational direction may include driving the second rotor with a drive.

The step of rotating the second rotor in the first rotational direction may include driving the first rotor with a drive, whereby the second rotor is driven in the first direction by rotating air in the turbo-molecular pump section.

The step of rotating the second rotor in the second rotational direction may further comprise progressively slowing the second rotor from rotation in the first direction, stopping the rotor and progressively accelerating the rotor in rotation in the second direction.

The method may also include the step of controlling a pressure of a chamber connected to the pump by controlling a relative rotational speed of the first and second rotors.

DESCRIPTION OF THE INVENTION

According to the present invention, a compound vacuum pump includes two rotors that are driven independently by two drives. One of the rotors includes forward-rotating arrays of turbo vanes as well as the rotor portions of the regenerative and/or drag sections. The other rotor includes counter-rotating arrays of vanes that replace the stator vanes of the prior art discussed above. By utilizing counter-rotating vanes in the turbo-molecular section of the pump, the operating angular velocity of the forward-rotating rotor may be reduced without degrading the performance of the turbo section, ameliorating some of the problems discussed above.

Figure 2:
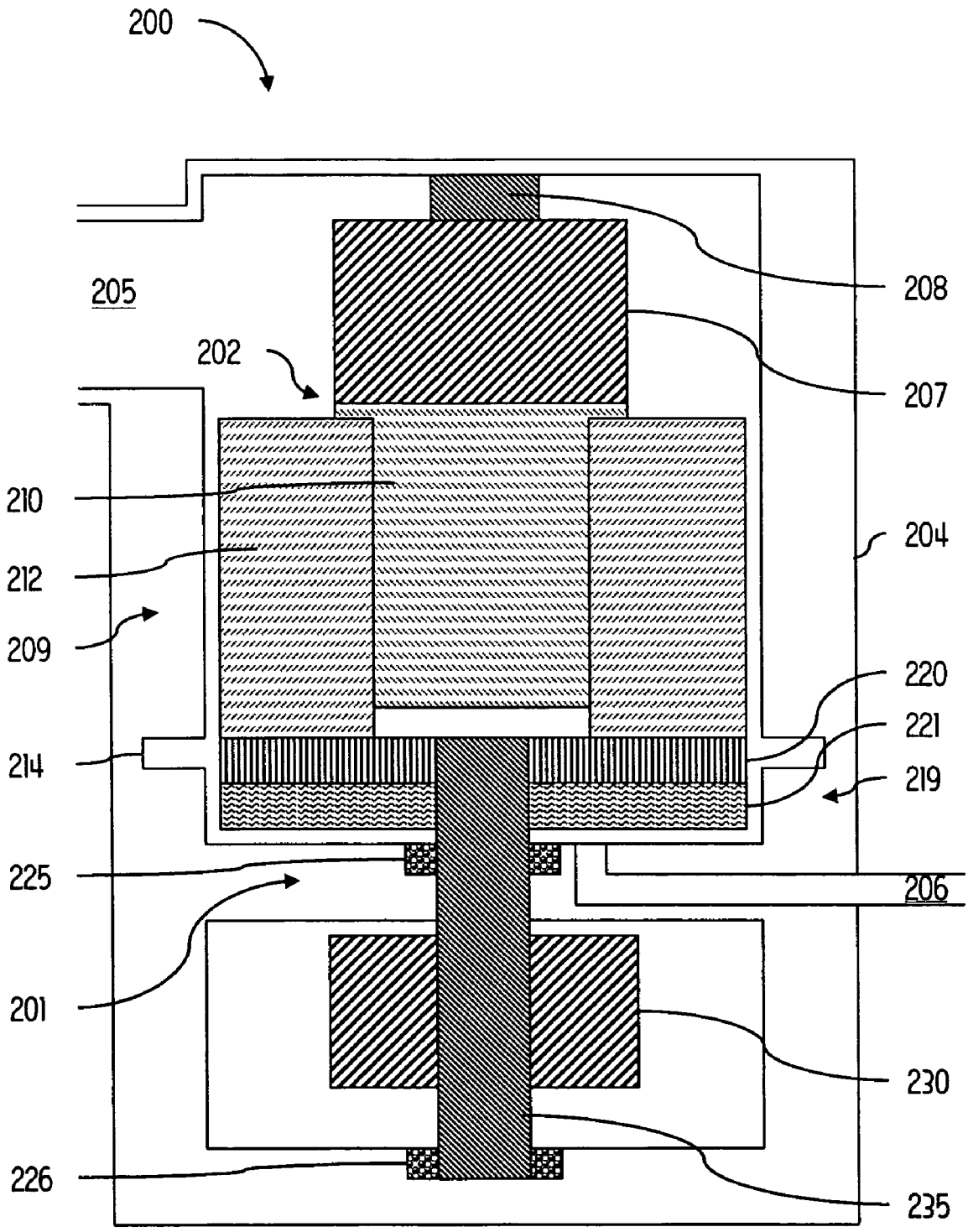
FIG. 2 is a schematic diagram showing a hybrid vacuum pump according to one embodiment of the invention.

Referring now to FIG. 2, a compound vacuum pump 200 according to the invention will be described. The pump 200 is housed in a body 204 having a pump inlet 205 and a pump outlet 206. The pump inlet 205 is the low pressure side of the pump and is connected, directly or indirectly, to a chamber to be evacuated. For example, the inlet 205 may be connected to a microelectronic wafer processing chamber, or to a detection chamber of a mass spectrometer. The outlet may exhaust to a secondary roughing vacuum pump or to atmosphere.

Figure 1:
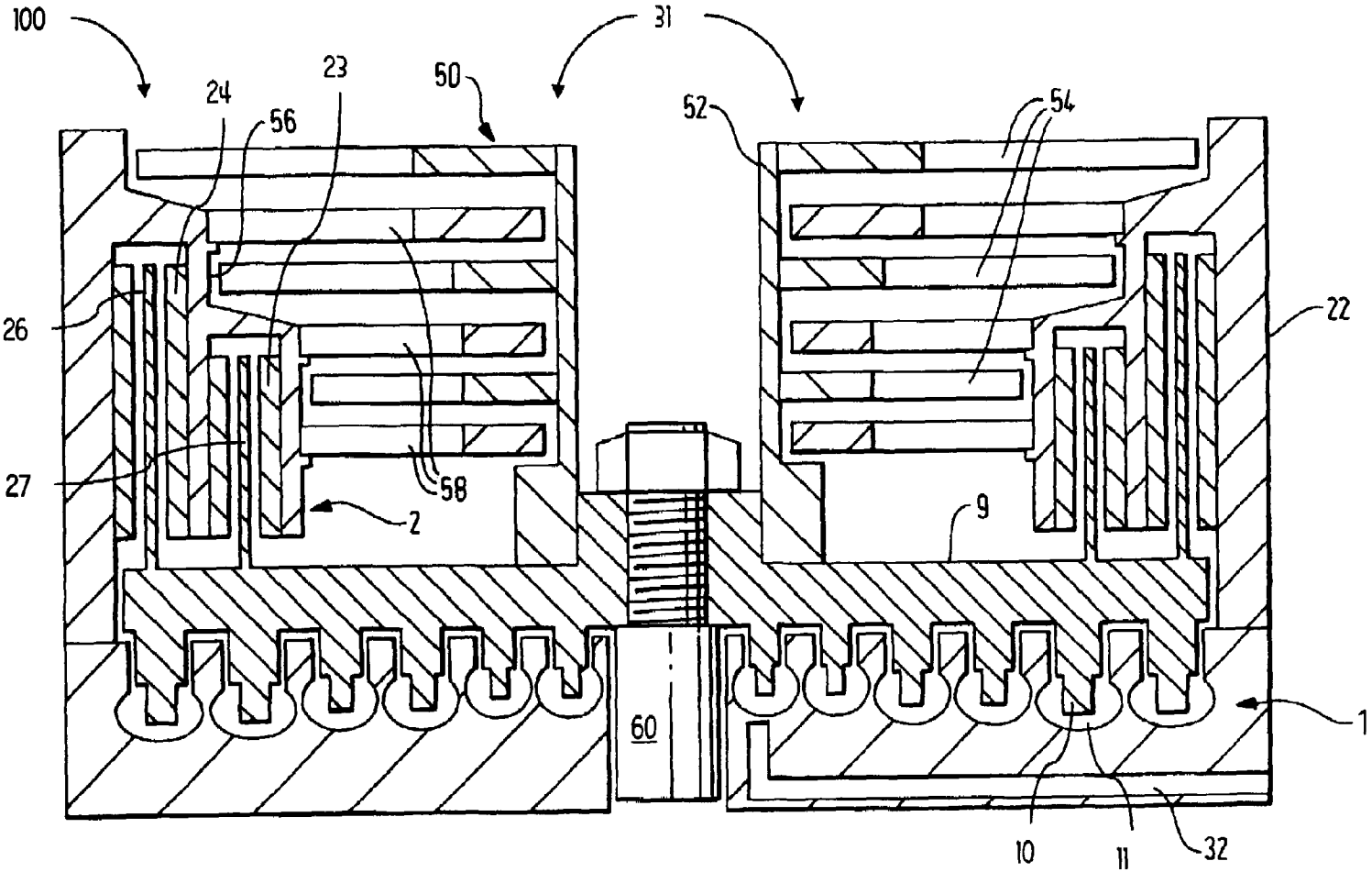
Fig. 1 (prior art)
FIG. 1 is a sectional view of the pump sections of a known hybrid vacuum pump having a turbo-molecular section, a molecular drag section and a regenerative section.

Two operational sections of the compound vacuum pump 200 are shown: a turbo-molecular pump section 209 and a regenerative section 219. A molecular drag section (not shown) is also included in a preferred embodiment of the invention. That section has been eliminated from the view of FIG. 2 for clarity. One skilled in the art will recognize that a molecular drag section such as the molecular drag section 2 of FIG. 1 may be incorporated in the inventive vacuum pump shown in FIG. 2 without undue alteration.

The compound vacuum pump 200 of the invention further has a first rotor 201 and a second rotor 202. The rotors 201, 202 support the rotating portions of the turbo-molecular pump section 209 and the regenerative section 219 as described below.

The first rotor 201 is driven by a drive 230 and suspended on bearings 225, 226. The drive 230 is preferably an inverter drive as is commonly used in the vacuum pump art. The bearings 225, 226 may be lubricated or dry, and preferably have ceramic rolling elements to reduce wear and micro pitting. The drive 230 is capable of rotating the first rotor 201 at a speed of about 18,000 RPM.

The first rotor 201 includes a regenerative rotor 220 of the regenerative section 219. The regenerative rotor rotates with the rotor first 201 and acts in concert with a regenerative stator 221. The regenerative stator 221 is attached to the body 204 and remains stationary during operation of the pump. The regenerative section inlet is an internal transfer port 214 communicating with the turbo-molecular section 209. The regenerative section exhausts through the pump exhaust port 206.

The first rotor 201 also includes an outer turbo-molecular rotor 212 of the turbo-molecular pump section 209. The outer turbo-molecular rotor 212 rotates with the first rotor 201 and includes radially-inwardly-extending vanes (not shown) as described above with reference to the vanes 58 of FIG. 1.

The second rotor 202 is supported on bearing 208 and driven by drive 207. The bearing 208 and drive 207 are preferably integral parts of a magnetic levitation drive as is frequently used in the art. The non-contact magnetic levitation drive permits high speed rotation without excessive bearing wear and frictional heat buildup, and with a minimum of vibration. The drive 207 is capable of driving the second rotor 202 at about 18,000 RPM.

The second rotor includes an inner turbo-molecular rotor 210 connected for rotation therewith. The inner turbo-molecular rotor includes radially-outwardly-extending vanes (not shown) as discussed above with respect to the vanes 54 shown in FIG. 1. The outwardly-extending vanes of the inner turbo-molecular rotor 210 are interleaved with the inwardly extending vanes of the outer turbo-molecular rotor 212 as is known in the art, and cooperate to form the turbo-molecular pump section 209.

While the outer turbo-molecular rotor has been described as connected to the first pump rotor and the inner turbo-molecular rotor has been described as connected with the second pump rotor, those relationships may be reversed. In other words, in an alternate embodiment, the inner turbo-molecular rotor may rotate with the regenerative rotor, and the outer turbo molecular rotor may be driven in counter-rotation.

In normal, steady-state operation, the first and second rotors turn in opposite directions, each at approximately 18,000 RPM. The regenerative rotor and regenerative stator therefore operate at a relative speed of 18,000 RPM, while the inner and outer turbo-molecular rotors operate at a relative speed of 36,000 RPM.

The above-described rotor configuration yields several advantages in steady-state operation. The turbo-molecular section of the pump is operated at a high relative speed, while subjecting the radial vanes to stresses induced by a rotation of the rotors that is only about one half the relative speed of the interleaved vanes. That allows a less bulky design of the vanes, and also permits the turbo-molecular section to be constructed with a smaller outer diameter than would otherwise be necessary to maximize tangential velocity.

Further, the turbo-molecular section of the pump may be operated a relative speed that is much greater than the relative speed of the stator and rotor of the regenerative section. That allows each section to be designed for a more optimal speed range. A molecular drag section of the pump, if included, also rotates with the first pump rotor and would also benefit from a design aimed at a lower, more optimal speed range than would otherwise be necessary to operate a turbo-molecular section with stators.

Figure 3:
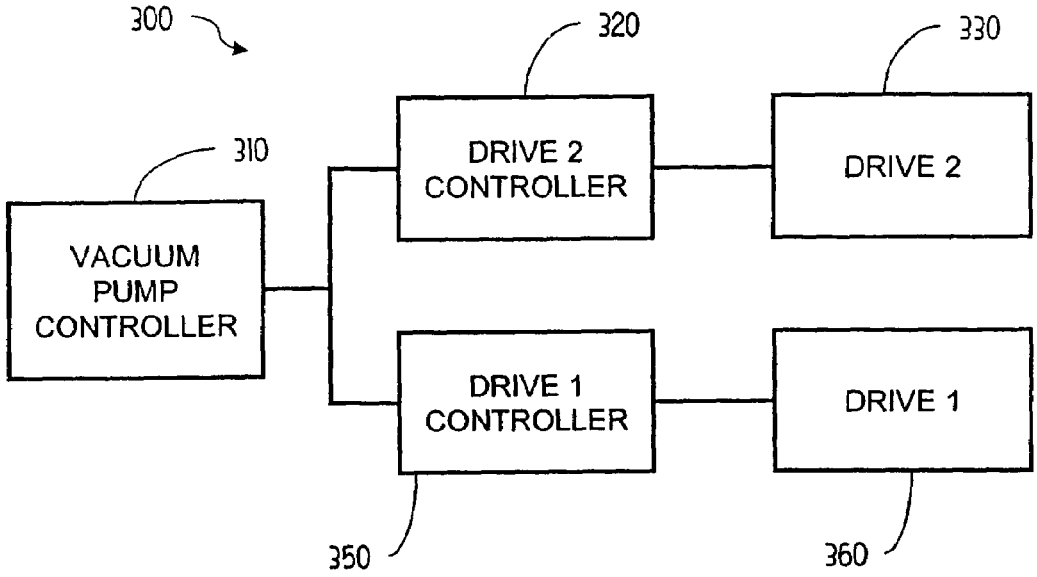
FIG. 3 is a schematic block diagram showing a pump drive control system according to one embodiment of the invention.

While the two rotors are driven independently, the drive controllers are connected to allow communication between them, as illustrated by the communication system 300 of FIG. 3. In that illustrative embodiment, the drives 330, 360 are connected to drive controllers 320, 350, respectively. The drive controllers, in turn, communicate with a single vacuum pump controller 310 responsible for the overall coordination between the drives. The controllers may communicate through a bus architecture.

The vacuum pump controller 310 coordinates the start-up and steady-state operation of the vacuum pump. For example, as illustrated by the velocity diagram 400 of FIG. 4, the vacuum pump controller may independently control the operation of the two drives to optimize the start-up sequence of the pump. The diagram illustrates a velocity profile 410 of the first rotor and a velocity profile 420 of the second rotor along a time axis 402 as a function of angular velocity 401.

During an initial period 450, the first rotor is accelerated by its drive in a first rotational direction (shown as the positive direction on the velocity axis 401). The regeneration rotor and the outer turbo-molecular rotor are thereby brought up to speed during that period 450.

During that same period 450, the second rotor, including the inner turbo-molecular rotor, also accelerates in the positive rotational direction. In one embodiment of the invention, the acceleration of the second rotor is induced by the frictional forces of the gasses in the turbo-molecular pump section on the vanes of the inner and outer turbo-molecular rotors. In other words, while the outer vanes of the turbo are driven, the inner vanes are allowed to freely rotate, and are induced by driven gasses in the turbo to rotate in the same rotational direction as the outer vanes. While the velocity profile of FIG. 4 shows the first rotor 410 and the second rotor 420 rotating at substantially the same angular velocity, it should be understood that the relative velocity of the two rotors may vary considerable while remaining within the scope of the invention.

In an alternative embodiment, the drive for the second rotor is reversible, and the second rotor is accelerated in the positive rotational direction shown during period 450 by the drive.

Because the inner and outer turbo-molecular rotors are rotating in the same direction at start-up, the pump may be run at full speed while gas still remains in the turbo-molecular section. That is not possible with a turbo rotor/stator arrangement, because high stresses are placed on the vanes by the unevacuated gas at high relative rotational speeds of the rotor and stator. With a rotor/stator arrangement, it is therefore necessary to at least partially evacuate the turbo-molecular section before bringing the pump up to speed.

Figure 4:
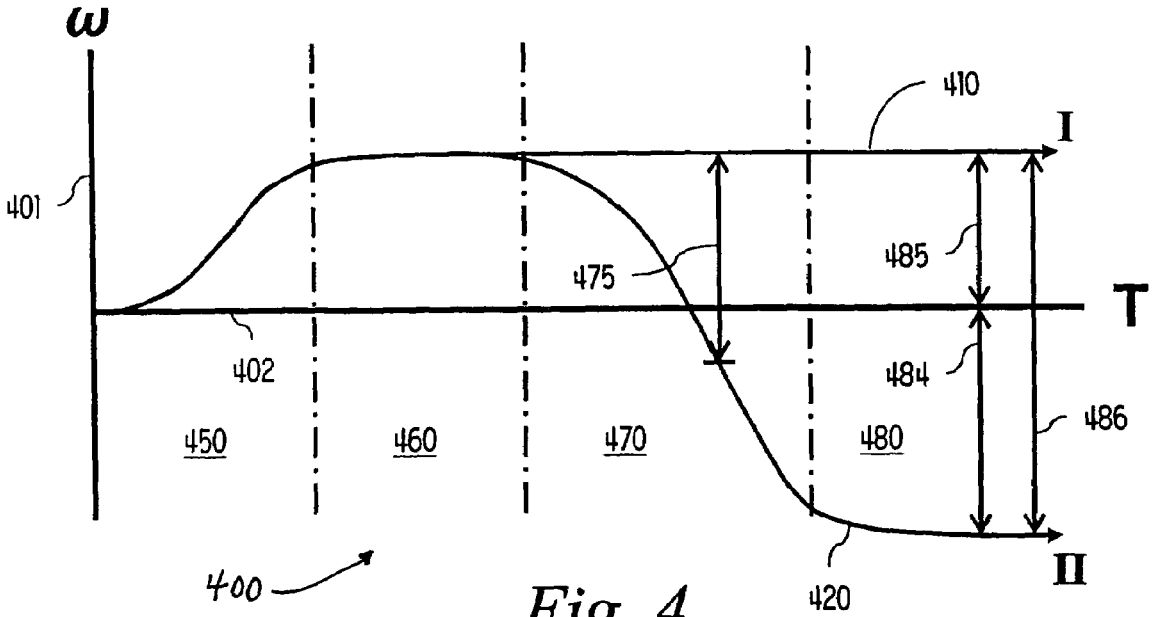
FIG. 4 is a velocity diagram showing rotor speeds during startup of a hybrid vacuum pump according to one embodiment of the invention.

After the first rotor 201 (FIG. 2) is brought up to speed, and the second rotor 201 is caused to rotate in the same direction to reduce stresses in the turbo-molecular section, the first rotor is maintained at speed for a period 460 (FIG. 4). During that period, the regenerative section of the pump operates at the full rotational speed of the second rotor (because it is a rotor/stator arrangement), and evacuates the turbo-molecular section sufficiently to permit counter-rotation of the vanes.

In the next start-up phase 470, the vacuum pump controller 310 (FIG. 3) activates the drive 207 (FIG. 2) to brake the rotation of the second rotor in the forward direction, stopping rotation, and to begin rotation in a reverse direction, while maintaining the rotation of the first rotor in the forward direction. As the rotational velocity of the second rotor changes, the relative rotational velocity 475 of the inner and outer turbo-molecular rotors increases, and the turbo-molecular section begins to operate. The rotation reversal is preferably controlled to be gradual, as shown in FIG. 4, to minimize stress on the components.

In one embodiment of the invention, the reversal phase 470 is started at a predetermined time after the first rotor is started; i.e., a timer is used to sequence the control. In another embodiment, a pressure sensor in the turbo-molecular section is monitored, and the controller 310 signals for reversal of the second rotor only after the turbo-molecular section has been sufficiently evacuated to begin counter-rotation of the vanes.

Phase 480 of the vacuum pump operation is the steady-state operation of the pump. It can be seen that the relative rotational speed 486 of the turbo-molecular rotors is greater than the rotational speed of either pump rotor. Further, the relative rotational speed 486 may be adjusted independently of the rotational speed 485 of the regenerative section by adjusting the rotational speed 484 of the second rotor. A pressure of an evacuated chamber connected to the turbo section can therefore be controlled by controlling the relative rotational speed of the first and second rotors.

It can also be seen from the diagram of FIG. 4 that, in the steady state, the relative rotational speed 485 of the regenerative rotor and stator is much less than the relative rotational speed 486 of the turbo-molecular rotors, permitting optimization of geometries of each of the sections.

Figure 5:
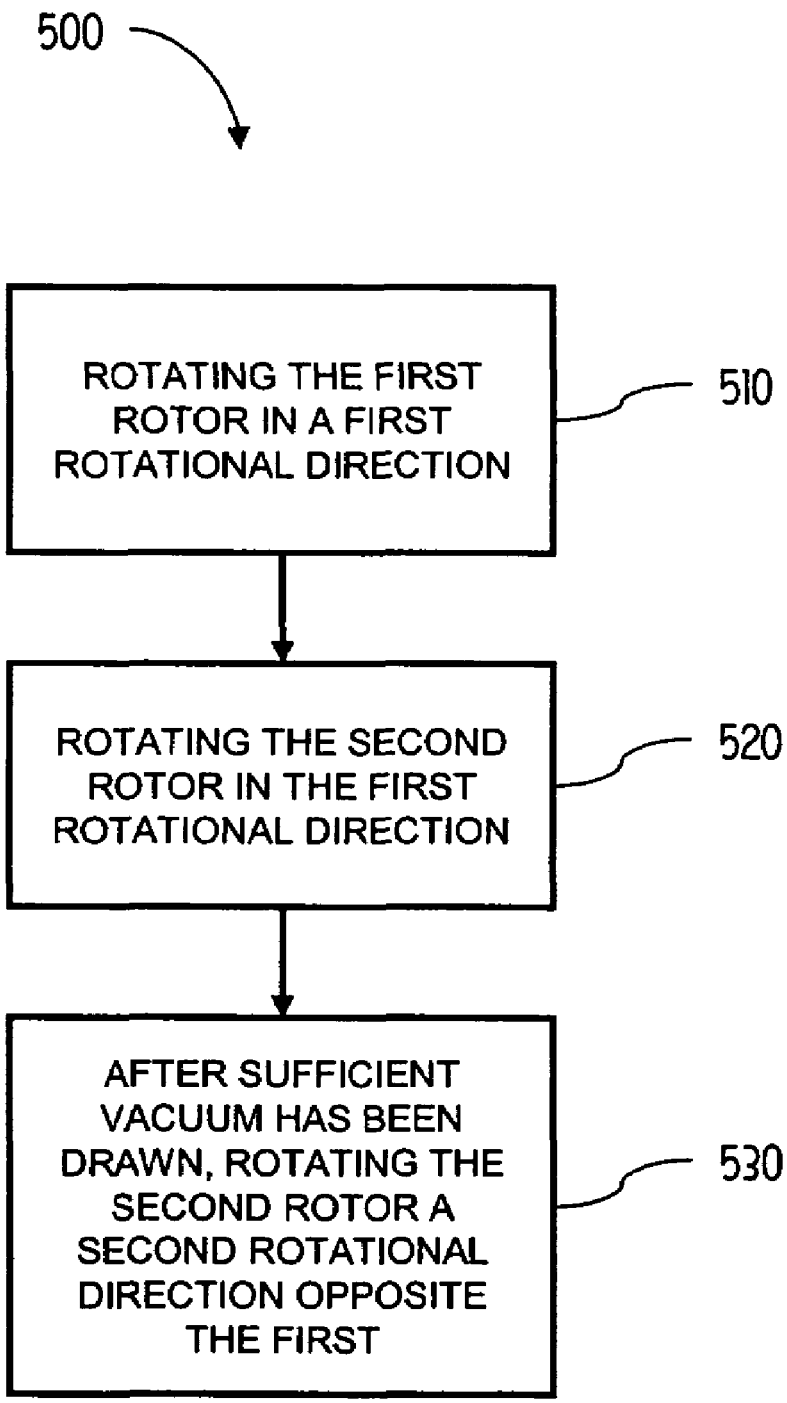
FIG. 5 is a block diagram showing method for starting a vacuum pump according to one embodiment of the invention.

A method 500 for controlling a vacuum exhaust pump having a turbo-molecular pump section and a regenerative pump section is illustrated in FIG. 5. The method is for a pump having a first rotor supporting elements of both pump sections, and a second rotor supporting additional elements of the turbo-molecular pump section.

Initially, the first rotor is rotated (step 510) in a first rotational direction. The second rotor may also be rotated (step 520) in the first direction by separately driving in the first direction with its own drive. Alternatively, the second rotor may simply be permitted to be rotated by gasses in the turbo-molecular section driven by elements supported by the first rotor.

After sufficient vacuum has been drawn in the turbo-molecular pump section, the second rotor is rotated (step 530) in a second rotational direction, opposite the first. The existence of sufficient vacuum may be detected using sensors, or may be estimated by time elapsed.

The foregoing Detailed Description is to be understood as being in every respect illustrative and exemplary, but not restrictive, and the scope of the invention disclosed herein is not to be determined from the Description of the Invention, but rather from the claims as interpreted according to the full breadth permitted by the patent laws. For example, while the system is described in connection with a high vacuum pump having a turbo molecular section and drag and/or regenerative sections, other vacuum pump geometries and functions may be incorporated. It is to be understood that the embodiments shown and described herein are only illustrative of the principles of the present invention and that various modifications may be implemented by those skilled in the art without departing from the scope and spirit of the invention.

What is claimed is:

1. A vacuum exhaust pump having a turbo-molecular pump section and a regenerative pump section, comprising:

a regenerative rotating group mounted for rotation about a pump axis;

a turbo rotating group connected to the regenerative rotating group for rotation therewith;

a first drive connected to the regenerative rotating group and the turbo rotating group for rotating those groups in a first rotational direction;

a turbo counter-rotating group mounted for rotation about the pump axis; and a second drive connected to the turbo counter-rotating group for rotating the turbo counter-rotating group in at least a second rotational direction opposite the first rotational direction.

2. The vacuum exhaust pump of claim 1, wherein the turbo counter-rotating group is an outer rotor of a turbo-molecular pump section.

3. The vacuum exhaust pump of claim 1, wherein the turbo counter-rotating group is an inner rotor of the turbo-molecular pump section.

4. The vacuum exhaust pump of claim 1, wherein the turbo counter-rotating group is mounted on magnetic levitation bearings.

5. The vacuum exhaust pump of claim 1, further comprising: a pump controller for controlling the first and second drives, the controller configured to activate the first drive during stan-up to rotate the regenerative rotating group and the turbo rotating group in the first direction without activating the second drive.

6. The vacuum exhaust pump of claim 1, wherein the second drive is for rotating the turbo counter-rotating group in both the first rotational direction and the second rotational direction.

7. The vacuum exhaust pump of claim 6, further comprising: a pump controller for controlling the first and second drives; the controller configured to rotate the turbo counter-rotating group in the first rotational direction during start-up, and to rotate the turbo counter-rotating group in the second rotational direction after a sufficient vacuum is drawn.

8. The vacuum exhaust pump of claim 7, wherein controller is further configured to progressively transition the turbo counter-rotating group from rotation in the first rotational direction to rotation in the second rotational direction.

9. The vacuum exhaust pump of claim 1, further comprising: a regenerative stator group having a close running clearance with the regenerative rotating group to form the regenerative pump section.

10. The vacuum exhaust pump of claim 1, further comprising: a pump inlet entering the turbo pump section; and a pump outlet leaving the regenerative pump section.

11. The vacuum exhaust pump of claim 1, further comprising: a molecular drag rotating group connected to the regenerative rotating group for rotation therewith.

12. A vacuum exhaust pump, comprising:

a regenerative section;

a turbo-molecular section;

a first rotor common to both sections having a first rotational direction; and a separately rotating second rotor of the turbo-molecular section having a second rotational direction counter to the first rotational direction.

13. A vacuum exhaust pump comprising:

a regenerative section:

a turbo-molecular section:

a first rotor common to both sections:

a separately rotating second rotor of the turbo-molecular section;

a first drive to drive the first rotor in a first rotational direction; and a second drive to drive the second rotor in a rotational direction opposite the first direction.

14. The vacuum exhaust pump of claim 13, further comprising: a controller for activating the first drive during startup before activating the second drive.

15. A method for controlling a vacuum exhaust pump having a turbo-molecular pump section and a regenerative pump section, comprising:

rotating in a first rotational direction a first rotor supporting elements of both pump sections; and after sufficient vacuum has been drawn in the turbo-molecular pump section, rotating in a second rotational direction, opposite the first, a second rotor supporting additional elements of the turbo-molecular pump section.

16. The method of claim 15, further comprising the step of: before sufficient vacuum has been drawn in the turbo-molecular pump section, rotating the second rotor in the first rotational direction.

17. The method of claim 16, wherein the step of rotating the second rotor in the first rotational direction comprises driving the second rotor with a drive.

18. The method of claim 16, wherein the step of rotating the second rotor in the first rotational direction comprises driving the first rotor with a drive, whereby the second rotor is driven in the first direction by rotating air in the turbo-molecular pump section.

19. The method of claim 16, wherein the step of rotating the second rotor in the second rotational direction further comprises progressively slowing the second rotor from rotation in the first direction, stopping the rotor and progressively accelerating the rotor in rotation in the second direction.

20. The method of claim 15, further comprising the step of: controlling a pressure of a chamber connected to the pump by controlling a relative rotational speed of the first and second rotors.

* * * * *

UNITED STATES PATENT AND TRADEMARK OFFICE

CERTIFICATE OF CORRECTION

PATENT NO. : 7,140,833 B2
APPLICATION NO. : 10/981226
DATED : November 28, 2006
INVENTOR(S) : Christopher M. Bailey It is certified that error appears in the above-identified patent and that said Letters Patent is hereby corrected as shown below:

Title page, item (73) Assignee, replace "LLC" with --Inc.--.

Signed and Sealed this

Twelfth Day of June, 2007

JON W. DUDAS
*Director of the United States Patent and Trademark Office*